United States Patent [19]

Woodson

[11] 4,077,297

[45] Mar. 7, 1978

[54] VARIABLE PITCH DRUM

[76] Inventor: Craig Woodson, 2314 Frey Ave., Venice, Calif. 90291

[21] Appl. No.: 654,761

[22] Filed: Feb. 3, 1976

[51] Int. Cl.[2] ..... G10D 13/02
[52] U.S. Cl. ..... 84/411 R; 84/420
[58] Field of Search ..... 89/104, 270–273, 89/411–421

[56] References Cited

U.S. PATENT DOCUMENTS

| | | | |
|---|---|---|---|
| 2,204,987 | 6/1940 | Gussak | 84/412 |
| 3,185,013 | 5/1965 | Gussak | 84/411 |
| 3,647,931 | 3/1972 | Koiskikaua | 84/418 X |

FOREIGN PATENT DOCUMENTS

| | | | |
|---|---|---|---|
| 1,224,484 | 6/1960 | France | 84/414 |

OTHER PUBLICATIONS

Latin Percussion, Inc., 1974 Catalog, p. 13.

*Primary Examiner*—Lawrence R. Franklin
*Attorney, Agent, or Firm*—Fraser and Bogucki

[57] ABSTRACT

An inexpensive drum which is pitch variable over at least a fifth includes an elongated hollow cylinder cardboard shell with a drum head extending radially beyond the shell positioned at each end and a substantially inelastic cord threaded under tension to alternate between hooks connected to heads on opposite ends of the drum. The cord is spaced apart from the outer circumference of the shell and the drum tone may be selectively modified by manually squeezing the cord toward the drum shell. Each drum head includes a rigid ring assembly having a pair of planar standard hardboard rings which are stapled together to sandwich a membrane therebetween. Nails are passed through the rings toward the opposite end of the drum with the nail ends being looped to form hooks for receiving the cord.

12 Claims, 5 Drawing Figures

VARIABLE PITCH DRUM

BACKGROUND OF THE INVENTION

1. Field of the Invention

This invention relates to variable pitch drums and more particularly to a variable pitch drum having a cylindrical shell and drum heads which extend rigidly a substantial distance beyond the circumference of the shell to support a tensioning cord which is alternately threaded between opposite ends of the drum spaced apart from the shell.

2. Description of the Prior Art

Variable pitch drums or so-called "talking" drums derive from West Africa. The ethnic African "talking" drums have a hollowed out wooden shell with a symmetrical hourglass configuration. Goat-skin head membranes are stretched across opposite ends of the shell and secured by a cord that is repeatedly threaded through supporting structure for the head membranes at alternately opposite ends of the drum. The small diameter of the shell midway along its length permits the cord to be selectively squeezed toward the shell to vary the head membrane tension and thereby change the drum pitch over at least a fifth in less than one half second.

SUMMARY OF THE INVENTION

A variable pitch drum includes a hollow cylinder cardboard shell extending along a longitudinal central axis between opposite ends which are substantially perpendicular to the axis. A drum head is positioned at each opposite end of the shell and a substantially inelastic nylon cord is threaded back and forth between alternate opposite drum heads. Multiple lengths of chords extend between the opposite drum heads spaced apart from the shell. The pitch of the drum may be continuously and rapidly manually varied by manually squeezing the chord lengths toward the drum shell to selectively increase or decrease the tension on the chord.

Each drum head includes a flexible membrane extending across an end of the drum and a rigid ring assembly which is secured to the membrane and which supports the chord lengths in spaced apart relationship to the cylindrical outer circumference of the drum shell. The ring assembly preferably forms a generally thin, radially extending planar annulus and extends from an inner circumference slightly greater than the drum shell to an outer circumference that is substantially radially spaced from the inner circumference. A plurality of hooks spaced about the ring assembly near the outer circumference receive the cord loops.

The ring assembly may be advantageously formed from two identical standard hardboard rings which receive and sandwich the membrane therebetween with the membrane being substantially coterminous with the outer circumference of the rings. A plurality of staples are spaced about the ring assembly near the outer circumference and pass through the two rings and the intermediate membrane to secure them in fixed relative position. The staples pass completely through the rings with the staple tips being crimped inwardly toward each other and back to engage the surface of the ring opposite the staple crossbar. Nails having noncircular heads are driven through the rings at spaced-apart locations near the outer circumference toward the opposite end of the drum with the nail ends being bent in an approximate semi-circle as they emerge through the ring to form the hooks which secure the cord to the head. Embedding of the generally rectangular nail heads into the pressboard of the ring assembly inhibits rotation of the hooks.

The membrane is preferably Mylar 0.005 to 0.010 inch and is dish shaped by heating to form a radially extending disk shaped portion extending across the end of the cylindrical shell, a radially extending and longitudinally spaced annular portion that is sandwiched between the rings and an annular, beveled collar portion extending therebetween. The collar portion allows the surface of the ring assembly to be positioned approximately flush with the disk shaped portion of the membrane.

BRIEF DESCRIPTION OF THE DRAWINGS

A better understanding of the invention may be had from a consideration of the following Detailed Description, taken in conjunction with the accompanying drawings, in which.

DETAILED DESCRIPTION

Figure 1:
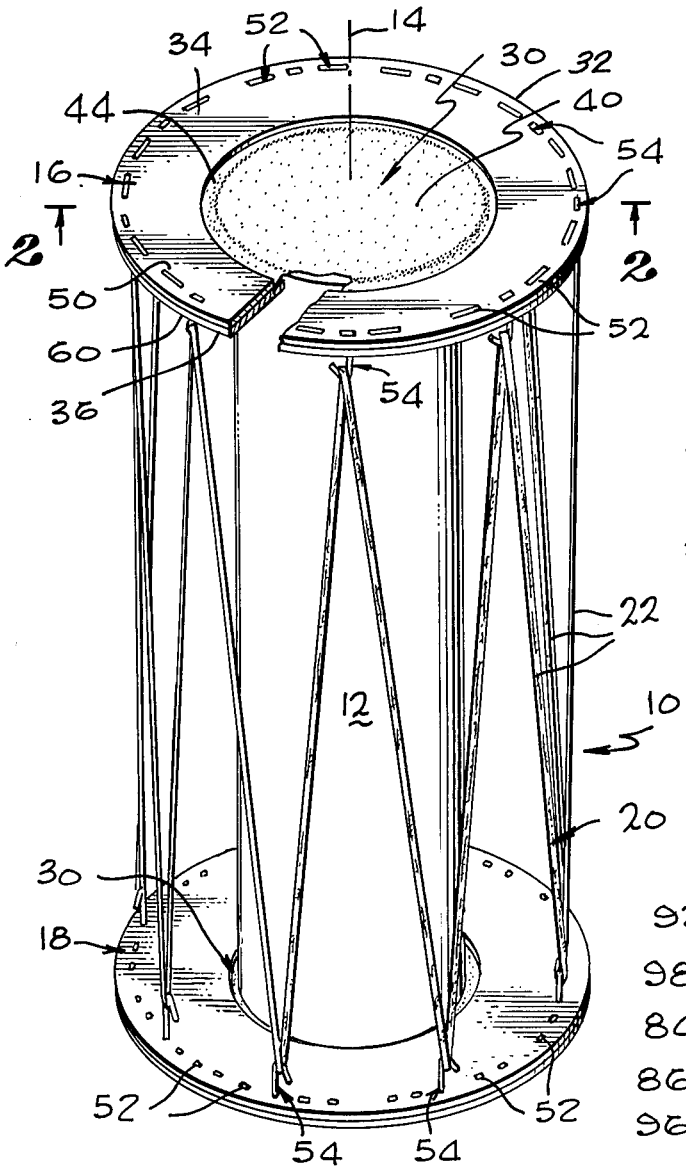
FIG. 1 is a perspective view, partly broken away, of a variable tone drum in accordance with the invention.

As shown in FIGS. 1–4, a variable tone drum 10 in accordance with the invention includes a hollow cylindrical shell 12 extending along a central longitudinal axis 14, and a pair of head assemblies 16, 18, and a cord 20 extending in multiple lengths 22 between alternately opposite head assemblies 16, 18. The shell 12 in one example is advantageously manufactured as a commercially available cardboard cylinder having an outside diameter of 4.5 inches (11.43 cm), a length of approximately 15 inches (38 cm), and a wall thickness of approximately 0.07 inch (0.178 cm). The opposed ends of the shell 12 are cut substantially flat and lie in planes substantially perpendicular to the longitudinal axis 14.

The head assemblies 16, 18 are substantially identical and each includes a membrane 30, and a ring assembly 32 having an upper ring 34 and a lower ring 36 sandwiching the membrane 30 therebetween.

The membrane 30 may be any suitable material which is sufficiently flexible and tough to form a drum head but is preferably cut from Mylar sheet having a thickness sufficient to permit the membrane 30 to be beat upon with a drum stick without sustaining damage. A thickness of 0.005 inch (0.0128 cm) has been found to be preferable. The membrane 30 is circular in shape with a diameter of approximately 8 inches (20.4 cm). The outer circumference of the membrane 30 conforms substantially in shape to the outer circumference of the ring assembly 32.

The membrane 30 is generally dish shaped with three concentric regions. If the membrane 30 is made of Mylar, it may be permanently molded into the dish shape by heating it to approximately 175° F. while the membrane 30 is held in conformity with a desired dish shape. The membrane 30 has a central disk shaped region 40 which is approximately coextensive with the outer circumference of the shell 12, a radially extending peripheral annular region 42 which is approximately coextensive with and sandwiched between rings 34 and 36, and a beveled or ramp shaped collar region 44 which is annular in nature and extends between the disk shaped region 40 and the peripheral annular region 42. The bevel in the collar region 44 of membrane 30 permits an outer surface 50 of ring 34 to be positioned substantially flush or coplanar with the disk shaped region 40. The bevel of collar region 44 provides a longitudinal displacement of approximately ⅛ inch (0.318 cm).

The ring assembly 32 includes the two nearly identical rings 34, 36 which are fastened together by staples 52 and nails 54 which pass therethrough to secure the rings 34, 36 in fixed relation to each other and to the peripheral ring 42 of membrane 30 which is sandwiched therebetween. The rings 34, 36 are preferably made of a material such as standard hardboard or wood which is capable of remaining substantially rigid under forces which would be typically exerted by a person playing the drum 10. The rings 34, 36 have a thickness of approximately ⅛ inch (0.318 cm) between opposed radially extending planar surfaces, a circular outer circumference with a diameter of approximately 8 inches (20.4 cm) and a circular inner circumference with a diameter of approximately 4.75 inches (12.1 cm). The radius of the inner circumference of axially inward ring 36 is approximately ⅛ inch (0.318 cm) larger than the radius of the outer circumference of shell 12 to provide adequate clearance to permit the ring assembly 32 to be readily positioned about the outer circumference approximately concentric with the longitudinal axis 14. The radius of the inner circumference of axially outward ring 34 is somewhat larger to provide for collar region 44 of membrane 30. The radius of the outer circumference of the ring assembly 32 should be substantially larger than the inner circumference and is preferably in the range of at least 1 to 2 inches (2.54 to 5.08 cm) larger to provide adequate clearance to squeeze the multiple links 22 of cord 20 radially inward toward the circumference of shell 12 to permit control over the tensioning of head membrane 30.

Figure 3:
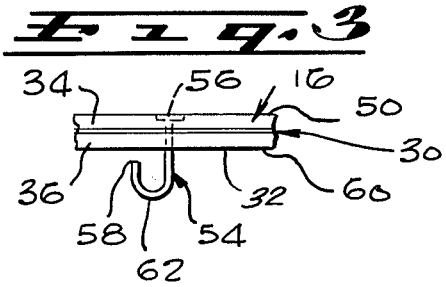
FIG. 3 is an enlarged, fragmentary side view of a portion of the drum shown in FIG. 1.

As shown more particularly in FIGS. 1 and 3, the nails 54 are spaced about the periphery of the ring assembly 32 and are positioned near the outer circumference. They may be of the type which is commonly known as 0.070 inch or 0.080 inch (0.178 or 0.203 cm) T-nail with a length of approximately 1½ inches (3.82 cm). The nails may be driven through the rings 34 and 36 in a direction towards the opposite end of the drum with the heads 56 being positioned adjacent outer surface 50 of ring 34 and partially embedded in surface 50 so that the head of nail 56 is positioned approximately flush with the outer surface 50. As the tip of nail 54 emerges through the ring 36 it is engaged by an anvil that constrains the pointed end 58 of the nail 54 to a semicircular path with the tip being returned back toward an inner surface 60 of ring 36. A sufficient distance is maintained between a tip 58 of nail 54 and inner surface 60 of ring 36 to permit cord 20 to be passed therebetween to form a loop. A noncircular, rectangular cross-sectional shape of head 56 of nail 54 prevents rotation of a hook 62 created by the bending of nail 54 when the head 56 is embedded in the surface 50. The nail 54 may be driven through the ring assembly 32 by a conventional industrial nailing machine in conjunction with an anvil as described here below.

Figure 4:
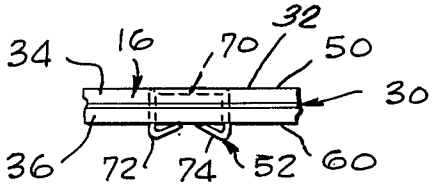
FIG. 4 is an enlarged, fragmentary side view of a portion of the drum shown in FIG. 1.

Referring now more particularly to FIGS. 1 and 4, the rings 34, 36 and peripheral annular portion 42 of membrane 30 are secured in fixed relation to one another by common staples 52 which are shaped about the ring assembly 32 near the outer circumference. For the disclosed example, the crossbar portion 70 of the staples 52 between legs 72, 74 has a length of 0.5 inch (1.27 cm) and the legs 72, 74 preferably have a length of 0.5 inch (1.27 cm). The staples may be inserted by a conventional industrial stapling machine and the tips of the legs 72, 74 are crimped inwardly toward each other and then back into contact with the inner surface 60 to provide a secure, tight fastening. The crossbar portion 70 is embedded slightly in the outer surface 50 of ring 34 until it is approximately flush therewith.

Figure 5:
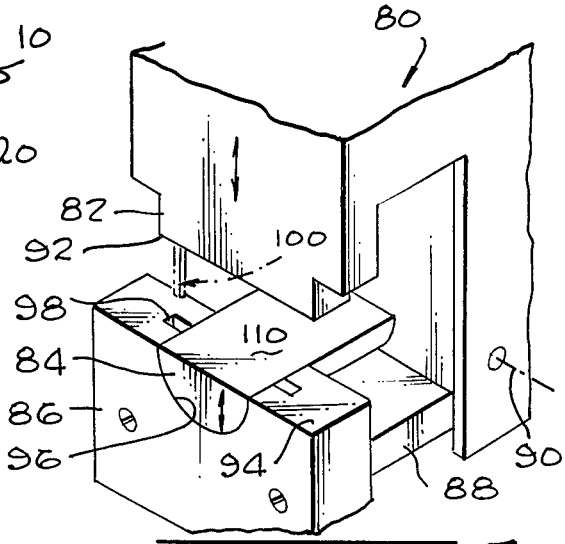
FIG. 5 is a perspective view of a nailing and forming machine for manufacturing drums in accordance with the invention.
Figure 2:
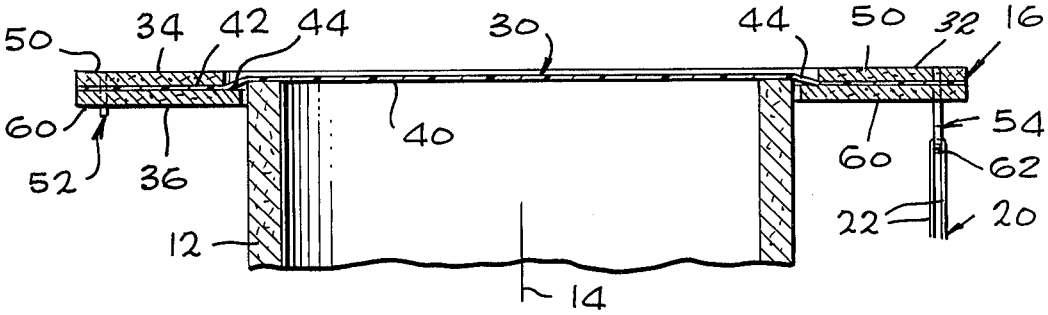
FIG. 2 is an enlarged, fragmentary section view of a portion of the drum shown in FIG. 1.

Referring now to FIG. 5, a machine 80 for inserting the nails 54 and forming the hooks 62 therefrom includes a conventional pneumatic nailing machine 82 which is only representatively illustrated, an elongated throw arm 84 which is secured in fixed relationship to the nailing machine 82 and with a half cylinder shape end in mating relationship with an anvil 86. The anvil 86 is secured to a support arm 88 with the support arm 88 being preferably mounted on a work bench or tool stand in fixed relationship thereto. The nailing machine 82 and throw arm 84 are pivotably coupled to the support arm 88 for rotation about an axis 90 which is preferably sufficiently far from the anvil 86 that relative motion between anvil 86 and a mating end of throw arm 84 remains substantially vertical as the nailing machine 82 and throw arm 84 pivot about the axis 90 sufficiently to move the mating ends of the throw arm 84 through a distance approximately equal to a radius of the throw arm 84 at the mating end.

When the nailing machine 82 is rotated into a nailing position with the end of throw arm 84 mating with anvil 86 as depicted in FIG. 5, a hammer head portion 92 of nailing machine 82 is spaced above a top surface 94 of anvil 86 a distance approximately equal to the thickness of a work piece through which a nail is to be inserted and a work piece (not shown) is positioned between the hammer head 92 and top surface 94. The anvil 86 has a semicircular groove cut 96 into the top surface 94 thereof with a radius conforming to a desired inside radius of curvature for a hook 62. In the present example, the diameter is approximately 5/16 inch (0.794 cm) with the center of curvature lying in the plain of surface 94. A slot 98 having a square cross-sectional shape which is sufficiently large to receive a pointed end of a T-nail 100 extends along the entire inner periphery of semicircular groove 96. As a nail 100 exits a piece of work positioned between head 92 and upper surface 94, it enters the slot 98 and passes through the slot 98 in conformity to the circular circumference of groove 96 through most of a semicircle to a point where the end of nail 100 lies within slot 98 and is positioned a short distance below the surface 94 on an opposite side of the groove 96 from which it entered.

The throw arm 84 is an elongated half cylinder member having a radius substantially equal to the radius of groove 96. Throw arm 84 is bounded on the top by an upper surface 110 which is substantially coplanar with upper surface 94. The circular periphery of throw arm 84 mates with the groove 96 and constrains a nail 100 to remain in the slot 98 and to follow the mating circumferences of the throw arm 84 and groove 96.

After a nail is driven through the work piece and around the mating end of throw arm 84 through slot 98, the throw arm 84 and nailing machine 82 are rotated about axis 90 to move the nailing head 92 and mating end of throw arm 84 substantially vertically upward with the work piece sandwiched therebetween. The mating end of throw arm 84 supports the work piece at the vicinity of the nail 100 to prevent damage to the work piece during rotation as the nail 100 may press against the sides of slot 98 with a fair amount of frictional force. Once the nailing machine 82 and support arm 88 are rotated upward, the nail 100 may be slid off the end of the mating end of throw arm 84.

While there has been described above a variable pitch drum in accordance with the invention for the purpose of enabling a person of ordinary skill in the art to make and use the invention, it will be appreciated that the invention is not limited thereto. Accordingly, any modifications, variations or equivalent arrangements within the scope of the appended claims should be considered to be within the scope of the invention.

What is claimed is:

1. A variable pitch drum head comprising:

a first, substantially rigid ring having a generally planar outer surface, a generally planar inner surface parallel to and spaced apart from the outer surface, an inner circumference and an outer circumference;

a membrane extending across the area defined within the inner circumference and at least part way from the inner circumference toward the outer circumference adjacent the inner surface of the first ring;

a second, substantially rigid ring having a generally planar outer surface, a generally planar inner surface parallel to and spaced apart from the outer surface of the second ring, an outer circumference which approximately conforms in shape and size to the outer circumference of the first ring, and an inner circumference that is slightly smaller than the inner circumference of the first ring, said inner circumference being slightly larger than the circumference of the drum shell intended to be used with the said drum head, the outer surface of the second ring being disposed adjacent the inner surface of the first ring with a portion of the membrane sandwiched therebetween;

means for securing the membrane in fixed relation between the first and second rings; and a plurality of hooks extending from the inner surface of the second ring adjacent the outer circumference, the hooks being suitable for receiving and supporting a head tensioning cord.

2. The drum head according to claim 1 above, wherein the first and second rings are a wooden material.

3. The drum head according to claim 2 above, wherein the securing means includes a plurality of staples extending through the first and second rings and membrane.

4. The drum head according to claim 3 above, wherein the membrane is substantially coextensive with the outer circumferences of the first and second rings and wherein the staples are positioned adjacent the outer circumferences of the first and second rings.

5. The drum head according to claim 2 above, wherein the hooks are each a nail with a noncircular head embedded in the first ring, each nail being bent into a hook-shaped configuration.

6. A head assembly for a variable pitch talking drum having an axially extending cylindrical shell, the head assembly comprising a rigid, radially extending annular ring assembly that is positionable about a periphery of the shell and extends between an inner circumference in close proximity to the shell periphery and an outer circumference that is radially spaced a substantial distance from the inner circumference to provide a large, radially extending distance between the inner and outer circumferences of the annular ring assembly, the radially extending distances being sufficient to permit substantial changes in pitch of the drum head by squeezing cord lengths which are attached to the drum head and extend axially alongside the shell within the radially extending distance, the ring assembly including a plurality of hooks spaced about the ring assembly near the outer circumference thereof for attachment to cord lengths; and a membrane for extension across an end of the shell, an outer periphery of the membrane being secured to the ring assembly.

7. A variable pitch drum comprising:

a hollow cylindrical shell extending along a central longitudinal axis between first and second opposite ends which extend generally perpendicular to the axis;

a pair of membranes extending across the opposite ends of the shell, the membranes extending beyond an outer circumference of the shell;

a pair of rigid, circular ring assemblies disposed adjacent the opposite ends of the shell, each having an inner circumference slightly greater than an outer circumference of the shell and an outer circumference substantially greater than the inner circumference, each ring assembly including a pair of rings secured in fixed relation to each other with a portion of a membrane extending beyond an outer circumference of the shell secured therebetween to permit tension to be developed across the membranes when the ring assemblies are forced toward one another, the ring assemblies each further including a plurality of hooks secured thereto, the hooks being spaced about the ring assemblies near the outer circumference and extending toward the opposite end of the shell; and a substantially inelastic cord threading the hooks on ring assemblies at alternately opposite ends of the drum shell to permit manual control over substantial changes in pitch of the drum tone by selectively manually squeezing the cord toward the drum shell, said substantial changes in pitch being permitted by a sufficient radial distance being provided between the inner and outer circumferences of said ring assemblies.

8. The drum according to claim 7 above, wherein each membrane of the pair of membranes includes a beveled annular collar region extending concentrically about the outer circumference of the shell.

9. The drum according to claim 7 above, wherein the shell is a cardboard cylinder.

10. The drum according to claim 7 above, wherein each of the rings is fabricated from a wooden material and wherein the rings and membrane of each ring assembly are secured in fixed relationship by U-shaped staples passing therethrough.

11. The drum according to claim 10 above, wherein the hooks are nails which are driven through the ring assemblies, the nails having ends thereof bent to form hooks.

12. The drum according to claim 11 above, wherein the nails have noncircular heads embedded in the ring assemblies to prevent rotation of the hooks and wherein the nails are in the shape of the letter J.

* * * * *